United States Patent [19]

Bach

[11] Patent Number: 4,717,283

[45] Date of Patent: Jan. 5, 1988

[54] INSTALLATION FRAME FOR A GRID SOIL CONFINEMENT SYSTEM

[75] Inventor: Gary Bach, Appleton, Wis.

[73] Assignee: Presto Products, Incorporated, Appleton, Wis.

[21] Appl. No.: 757,588

[22] Filed: Jul. 22, 1985

[51] Int. Cl.[4] ..... E02B 3/12

[52] U.S. Cl. ..... 405/17; 404/17; 405/258

[58] Field of Search ..... 405/15, 16, 17, 229, 405/258; 404/17, 34, 35

[56] References Cited

U.S. PATENT DOCUMENTS

| | | | |
|---|---|---|---|
| 512,579 | 1/1894 | Flannery . | |
| 1,724,843 | 8/1929 | Kuhn . | |
| 1,725,239 | 8/1929 | Williams et al. . | |
| 2,329,670 | 9/1943 | Sanchez | 94/3 |
| 2,721,369 | 10/1955 | Burke | 25/155 |
| 3,506,531 | 4/1970 | Stander | 161/82 |
| 3,699,686 | 10/1972 | De Winter | 61/38 |
| 4,027,408 | 6/1977 | Ramella | 37/141 T |
| 4,033,139 | 7/1977 | Frederick | 61/53.5 |
| 4,192,383 | 3/1980 | Kirkland et al. | 166/341 |
| 4,448,569 | 5/1984 | Hackman et al. | 405/190 |
| 4,449,847 | 5/1984 | Scales et al. | 405/19 |
| 4,460,291 | 7/1984 | Lamendour | 404/35 |

FOREIGN PATENT DOCUMENTS

| | | |
|---|---|---|
| 3132038 | 3/1983 | Fed. Rep. of Germany . |
| 2299462 | 3/1978 | France . |
| 1379147 | 1/1975 | United Kingdom . |
| 1525173 | 9/1978 | United Kingdom . |
| 1582284 | 1/1981 | United Kingdom . |

OTHER PUBLICATIONS

Burns, Traffic Tests of Expedient Airfield Construction Concepts for Possible Application in the National Petroleum Reserve Alaska (NPRA) Technical Report GL-79-2 (1979).

Mitchell, et al., Analysis of Grid Cell Reinforced Pavement Bases, Technical Report GL-79-(1979).

Webster, Investigation of Beach Sand Trafficability Enhancement Using Sand-Grid Confinement and Membrane Reinforcement Concepts, Technical Reports GL-79-20 (Report 1) (1979), (Report 2) (1981).

Webster, et al., Investigation of Construction Techniques for Tactical Bridge Approach Roads Across Soft Ground, Technical Report S-77-1 (1977).

Webster, et al., Investigation of Construction Concepts for Pavements Across Soft Ground, Technical Report S-78-6 (1978).

Bach, Geoweb Technical Publication (1984).

Wider Application for Tensar Geogrids, News Briefs—The Civil Engineer in South Africa, p. 307 (Jun. 1984).

Army's Beachhead is Low-Cost Road, Engineering News-Record, p. 30 (May 28, 1981).

Paving Grid Repertoire Expands, Engineer News--Record, p. 32 (Jul. 1984).

Kennepohl, et al., "Construction of Tensar Reinforced Asphalt Pavements", Symposium on Polymer Grid Reinforcement in Civil Engineering (1984).

"Soil Stabilization with 'Tensar' Geogrid Structures," Symposium on Polymer Grid Reinforcement in Civil Engineering (1984).

"New Tensar Polymer Grids and Your Bottom Line," Symposium on Polymer Grid Reinforcement in Civil Engineering (1984).

"Engineering Fabrics," Symposium on Polymer Grid Reinforcement in Civil Engineering (1984).

"Phillips 66 SUPAC," Symposium on Polymer Grid Reinforcement in Civil Engineering (1984).

Phillips, et al., "A Review of Selected Literature on Sand Stabilization," 2 Coastal Engineering 133-47 (1978).

Pavement Design for Frost Conditions, Department of the Army Technical Manual TM5-818-2 (1965).

*Primary Examiner*—David H. Corbin

*Attorney, Agent, or Firm*—Willian Brinks Olds Hofer Gilson & Lione Ltd.

[57] ABSTRACT

The present invention is a frame for installing a grid section of cells of a grid confinement system for soil. The frame is generally planar having holding members on two sides to engage the grid section of cells. Each holding member can be independently controlled to engage or disengage the grid section of cells. Also, the frame is ventilated. The frame facilitates road center line reference, edge cell interlock and underwater installation.

48 Claims, 31 Drawing Figures

INSTALLATION FRAME FOR A GRID SOIL CONFINEMENT SYSTEM

BACKGROUND AND SUMMARY OF THE INVENTION

The present invention relates to a frame for installation of a material. Specifically, the present invention relates to an installation frame for grid soil confinement systems.

U.S. Pat. No. 1,724,843 discloses a concrete reinforcement support which may be hollow or solid and includes a plurality of reinforcement supporting legs which are clamped into position by a bolt to the concrete reinforcement. Additionally, the entire concrete reinforcement support may be moved to a new location.

U.S. Pat. No. 2,329,670 discloses a process for making pavements and the like which includes stretching members adapted to the fixed outside the area to which the flooring or surface is to be applied and also includes mechanisms for drawing the strips taut and retaining them in a fixed position.

U.S. Pat. No. 1,725,239 discloses a concrete reinforcement support for supporting fabric sheets in concrete roads, and the like. The concrete reinforcement support suspends the fabric sheet from side forms when the concrete is poured. The concrete reinforcement support can be removed from the fabric sheet before the concrete has completely set. The concrete reinforcement support is usually tubular. A series of bolt-like members extends through holes in the concrete reinforcement support having a hook portion at the lower end of each member which engages the fabric sheet. A major difference between U.S. Pat. No. 1,725,239 and the present invention is that U.S. Pat. No. 1,725,239 has spring-like handles secured to one or both ends of the concrete reinforcement support while the present invention has a control means at every grid section holding member. More specifically, the present invention has a control means for each grid section holding means which is independently operable wherein each grid section holding means can be controlled independently of any other grid section holding means. In the preferred embodiment of the present invention, the control means is a "T" handle which is externally mounted on the holding member, and the holding means is a "J" hook which is externally mounted on a plurality of the holding members. U.S. Pat. No. 1,725,239 discloses a single concrete reinforcement support and does not disclose, teach or suggest connecting the supports to form a support frame as is disclosed in the present invention. The concrete reinforcement support of U.S. Pat. No. 1,725,239 is supported on concrete side forms for roadways or the like by resting each end of the concrete reinforcement support across the top of two concrete side forms which are not integrally or externally connected to any other concrete reinforcement support. The spring-like handles engage the side forms and hold the concrete reinforcement support and bolt-like members into position, thus holding the fabric sheet in position. The bolt-like members are adjustable in a vertical direction. Additionally, each bolt-like member of the concrete reinforcement support of U.S. Pat. No. 1,725,239 rotates with the concrete reinforcement support about an axis parallel to the plane of the fabric sheet while the present invention has a grid section holding means which rotates about an axis perpendicular to the plane of the grid section of cells.

U.S. Pat. No. 512,579 discloses a method of laying tiles.

U.S. Pat. No. 2,721,369 discloses a method of concrete floor construction.

The grid confinement concept is described in the following articles: Burns, Cecil D., Technical Report GL-79-2, Traffic Tests of Expedient Air Field Construction Concepts for Possible Application in The National Petroleum Reserve—Alaska (NPRA), Geotechnical Laboratory, U.S. Engineer Waterways Experiment Station, Vicksburg, Miss. (March 1979); Mitchell, James K., Kao, T-C., Kavazanjian, Jr., Edward, Technical Report GL-79-8, Analysis of Grid Cell Reinforced Pavement Bases, Department of Civil Engineering, University of California, Berkeley, Calif. and Geotechnical Laboratory, U.S. Army Engineer Waterways Experiment Station, Vicksburg, Miss. (July 1979); Webster--Steve L., Technical Report GL-79-20, Investigation of Beach Sand Trafficability Enhancement Using Sand-Grid Confinement Sand Test Sections and Membrane Reinforcement Concepts, Report 1, Sand Test Sections 1 and 2, Geotechnical Laboratory, U.S. Army Engineer Waterways Experiment Station, Vicksburg, Miss. (November 1979); Webster Steve L., Technical Report GL-79-20, Investigation of Beach Sand Trafficability using Sand-Grid Confinement and Membrane Reinforcement Concepts, Report 2, Sand Test Sections 3 & 4, Geotechnical Laboratory, U.S. Army Engineer Waterways Experiment Station, Vicksburg, Miss. (February 1981); Webster, Steve L. and Watkins, James E., Technical Report S-77-1, Investigation of Construction Techniques for Tactical Bridge Approach Roads Across Soft Ground, Soils and Pavement Laboratory, U.S. Army Engineer Waterways Experiment Station, Vicksburg, Miss. (February 1977); and Webster, Steve L. and Alford, Samuel J., Technical Report S-78-6, Investigation of Construction Concepts for Pavement Across Soft Ground, Geotechnical Laboratory, U.S. Army Engineer Waterways Experiment Station, Vicksburg, Miss. (July 1978).

The need for an effective soil strength improvement system, capable of taking the heaviest loads and stabilizing the poorest soils, has existed for many years. A three-dimensional grid confinement concept was developed at the Geotechnical Laboratory, U.S. Army Engineer Waterways Experiment Station, Vicksburg, Miss. and supplemented by Research at the Department of Civil Engineering, University of California, Berkeley. The U.S. Army Corps of Engineers investigated methods of expedient paving for roads, airfields, bridge approaches, including traffic surfaces built on beaches and dune sands. Pavements for such roads, airfields, bridge approaches, protective bunkers or walls and traffic surfaces on beaches and dune sands surfaces are usually placed over poor quality subgrades when good quality crushed stone is unavailable. Significant work has been done to utilize the fine granular materials which are usually found in abundance in these areas, for example, fine granular materials which are usually found in abundance in these areas, such as fine river bank sand, uniformed sized beach and dune sands and the like. The U.S. Army Corps of Engineers reported that the principal of confinement offered the most promising solution to the unavailability of good quality crushed stone.

The U.S. Army Corps of Engineers evaluated the efficiency of square aluminum grid sections to determine the effects of cell size, cell depth and cell wall thickness. The aluminum grids were shown to be highly efficient but not cost effective for use as pavement bases. Alternate grid materials were also investigated. Paper grids with hexagon-shaped cells were tested, but the wet performance of this material was poor. Resin and pregnated paper cells were tested and also proved to be inferior when wet or when subjected to direct traffic.

The U.S. Army Corps of Engineers also tested a grid section of cells known as Geoweb, a trade-mark of Presto Products, Incorporated, P.O. Box 2399, Appleton, Wis. 54913 which is registered in the U.S. Patent and Trademark Office. The U.S. Army Corp of Engineers demonstrated that Geoweb is suitable to confine sand, rounded rock, poorly graded aggregates and the like. The Geoweb grid confinement system utilizes cells which are sinuous or undulent, and the grid section is honeycomb-like in appearance. Geoweb is fcrmed from a plastic resin. Grid sections of Geoweb can be installed by inexperienced labor to produce a good surface for traffic over an area otherwise unable to support traffic.

Current methods of installation require stretching a grid section of cells over a wood frame having rods disposed along two short sides of the frame, rotating the frame into position, anchoring the grid section with in-fill material or stakes and removing the frame. Alternatively, a grid section of cells may be installed without the use of a wood frame wherein eight laborers are required for proper installation.

The present invention is a frame for installing a grid section of cells of a grid confinement system for soil. The frame is generally planar having a plurality of support members forming sides and providing support therefor whereby each support member is connected to two or more support members. A plurality of grid section holding members are disposed along two sides of the frame to engage the grid section of cells. Each grid section holding member has a grid section holding means for engaging the grid section of cells and a control means for activating the grid section holding means. The control means for each grid section holding means is independently operable or independently actuated wherein each grid section holding means can be controlled independently of any other grid section holding means. The present invention is useful in installing grid sections on soil such as sand, clay, silk, rock, organic matter and combinations thereof. The cells of the grid sections are formed from paper, alloy, metal, or a plastic resin. Both thermoformed and thermoset plastic resins may be used. The grid section may be a honeycomb of cells, undulent cells, sinuous cells, or any geometric pattern of cells. The present invention requires fewer laborers to install, no string line is needed and uniformity is achieved. Each grid section may be easily positioned or repositioned. The frame provides easy road center line reference, easy edge cell interlock and easy underwater installation.

It is an object of the present invention to provide a frame for installing a grid section of cells of a grid confinement system for soil.

It is another object of the present invention to provide a generally planar frame having a plurality of support members forming sides of the frame whereby each support member is connected to two or more support members.

It is a further object of the present invention to provide a generally planar frame having a plurality of grid section holding members disposed along two sides of the generally planar frame to engage the grid section of cells.

It is a further object of the present invention to provide grid section holding means for each grid section holding member for engaging each grid section of cells.

It is a further object of the present invention to provide a control means on each holding member for activating each grid section holding means.

It is a further object of the present invention to provide a control means for each grid section holding means which is independently operable.

These and other objects of the present invention will be apparent from the description of the preferred embodiments which follows. Such objects are not intended to limit the scope of the present invention.

FIG.s 2–13 illustrate components of an installation frame.

Figure 14:
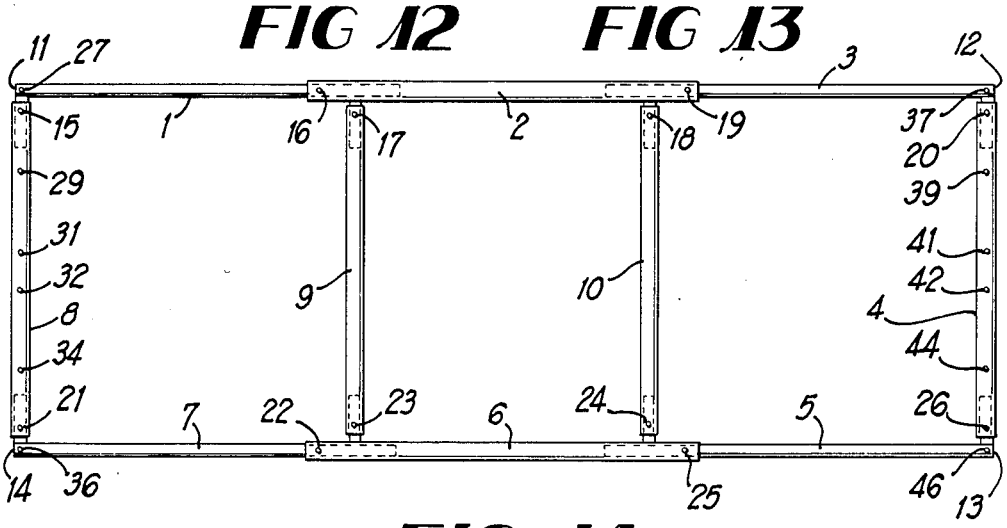

FIG. 14 illustrates an installation frame showing a first alternate embodiment.

Figure 15:
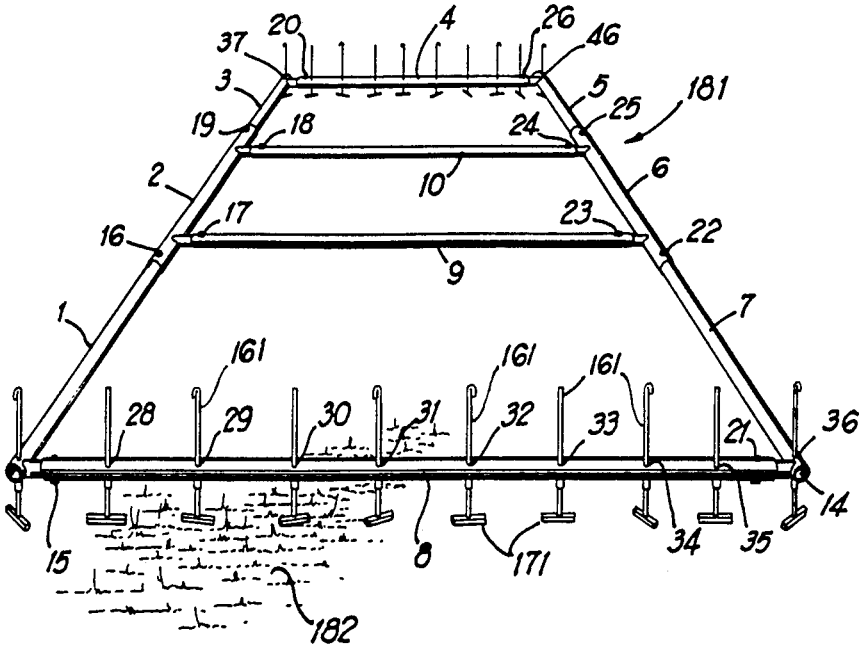
Figure 16:
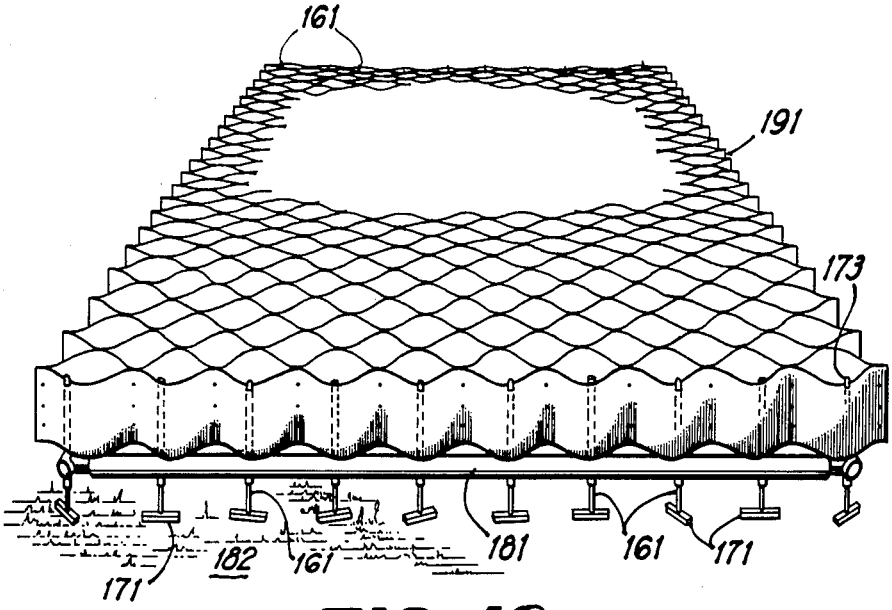

FIG. 15 illustrates a completely assembled installation frame;

FIG. 16 illustrates an installation frame having a grid section of cells secured thereto.

Figure 17:
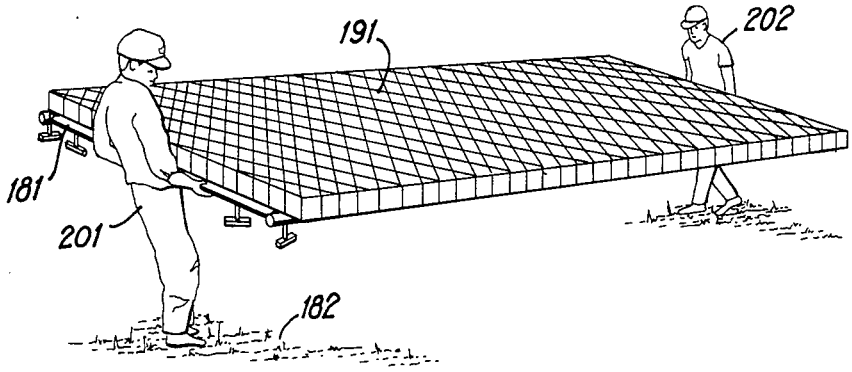

FIG. 17 illustrates transporting an installation frame having a grid sections of cells secured thereto to an installation site.

Figure 18:
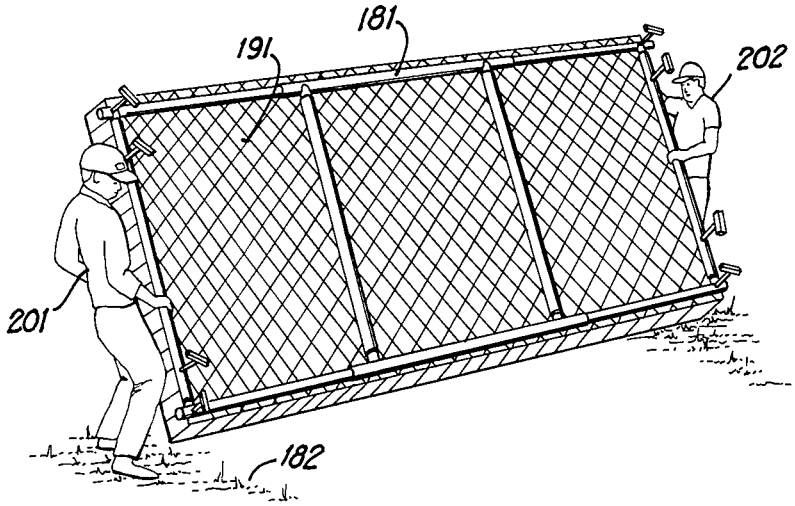

FIG. 18 illustrates rotating an installation frame having a section of cells secured thereto.

Figure 19:
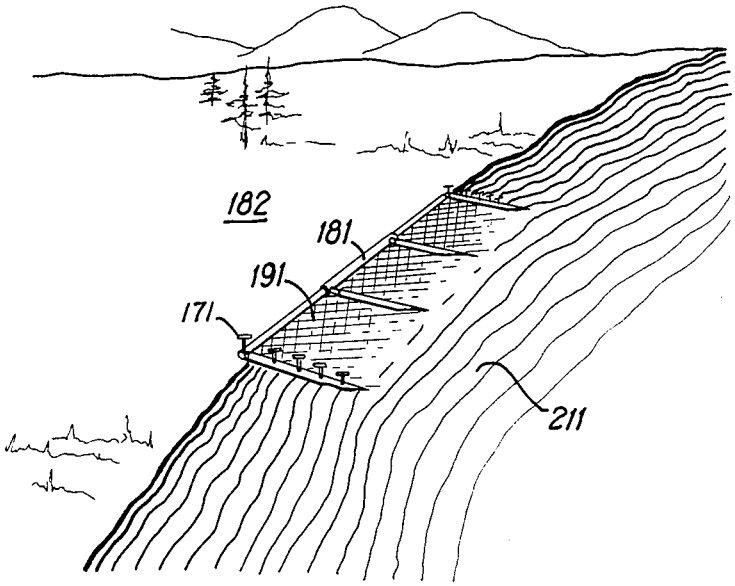

FIG. 19 illustrates positioning an installation frame having a grid section of cells secured thereto at an underwater installation site.

Figure 20:
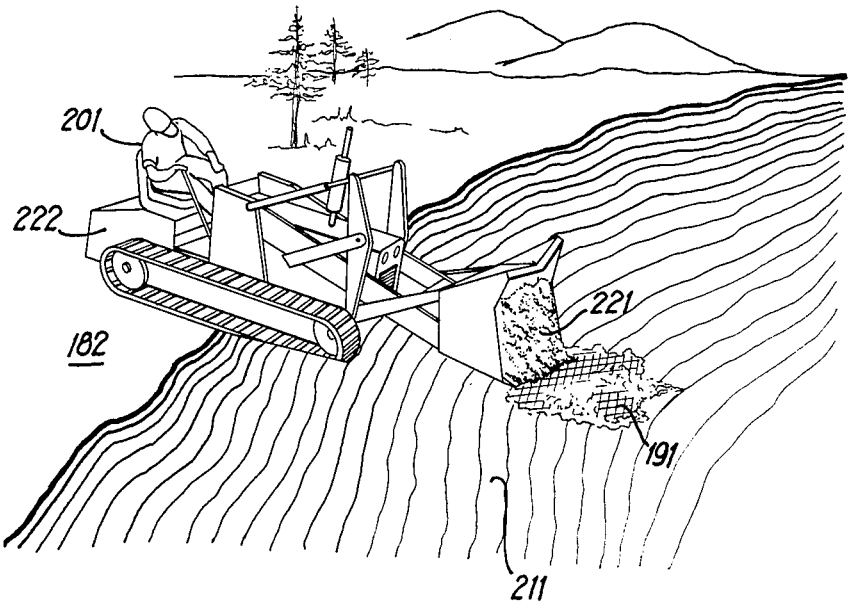

FIG. 20 illustrates in-fill material being placed on the grid section of cells.

Figure 21:
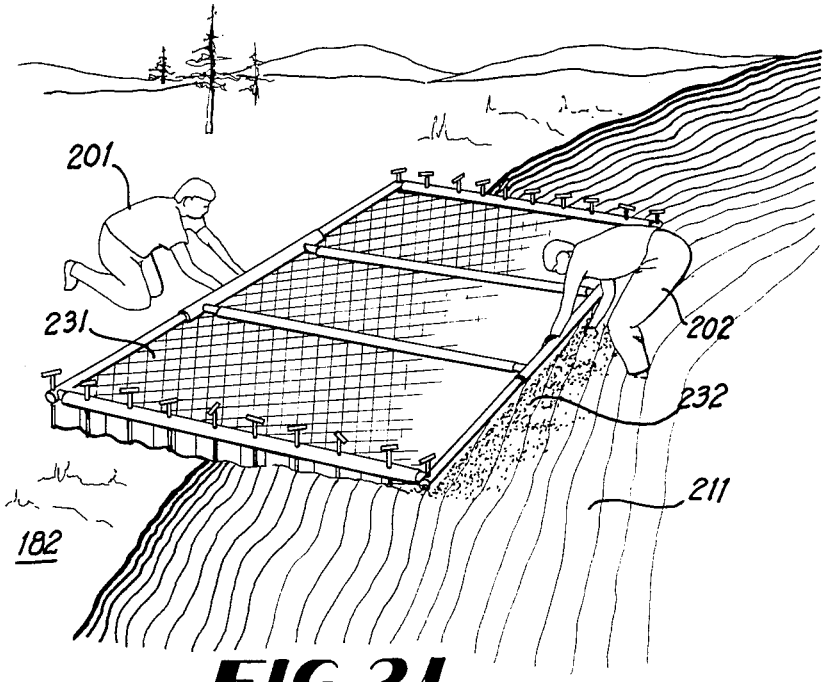

FIG. 21 illustrates a second grid section of cells.

Figure 22:
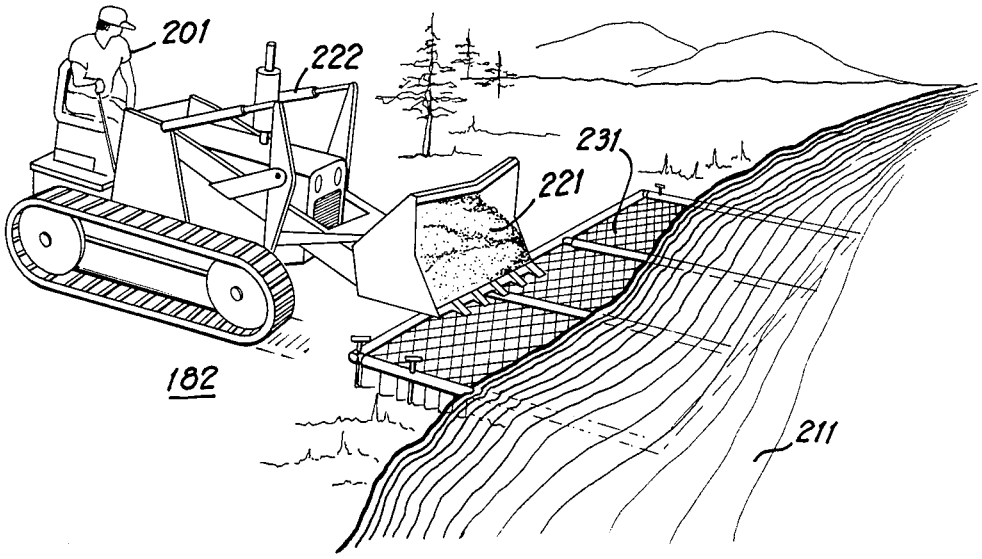

FIG. 22 illustrates in-fill material being placed on the grid section of cells.

Figure 23:
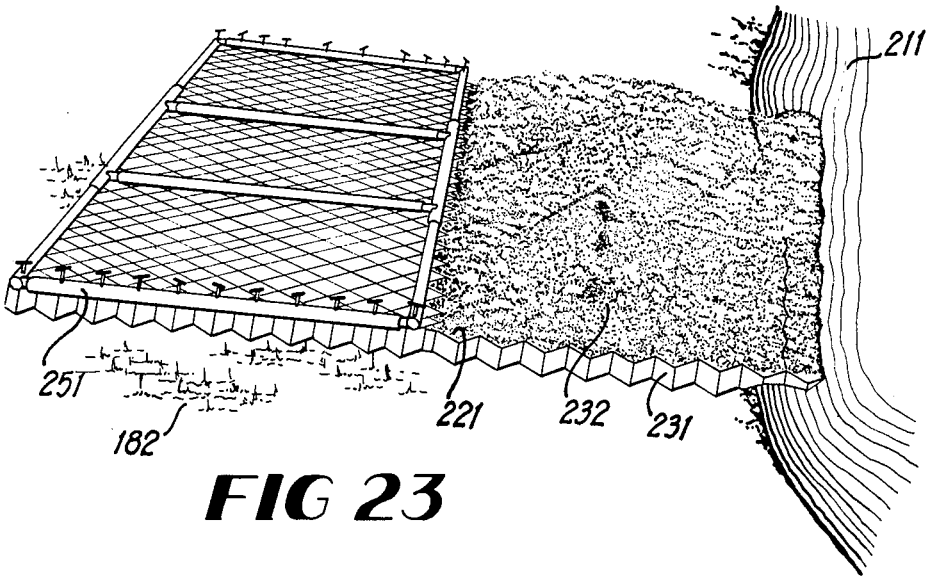

FIG. 23 illustrates a third grid section of cells.

Figure 24:
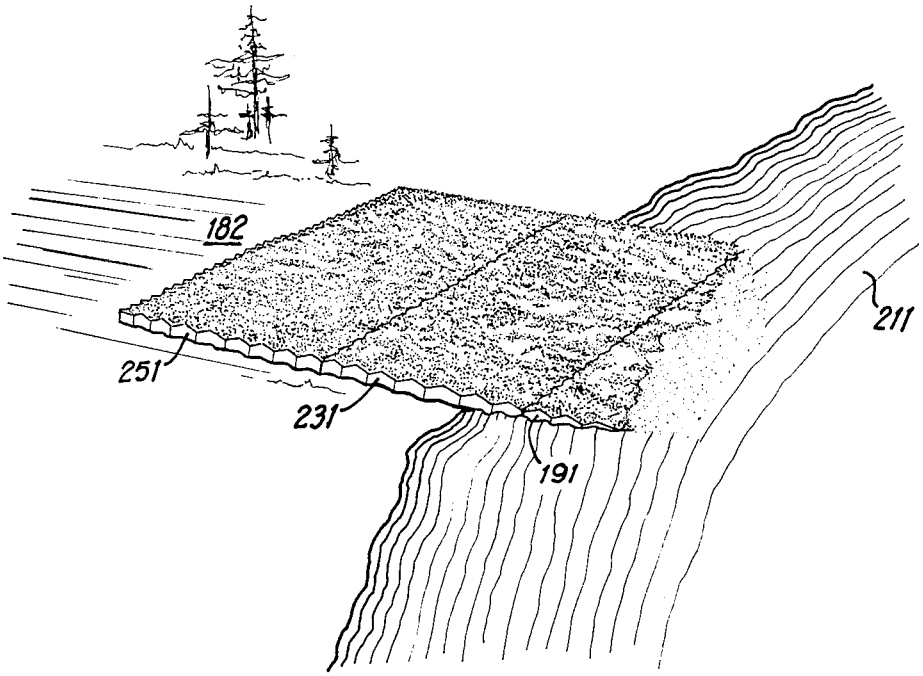

FIG. 24 illustrates three grid sections of cells.

Figure 25:
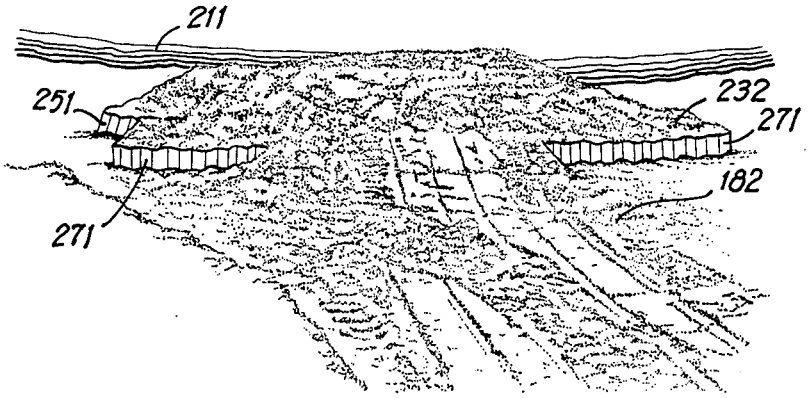

FIG. 25 illustrates a fourth grid section of cells.

Figure 26:
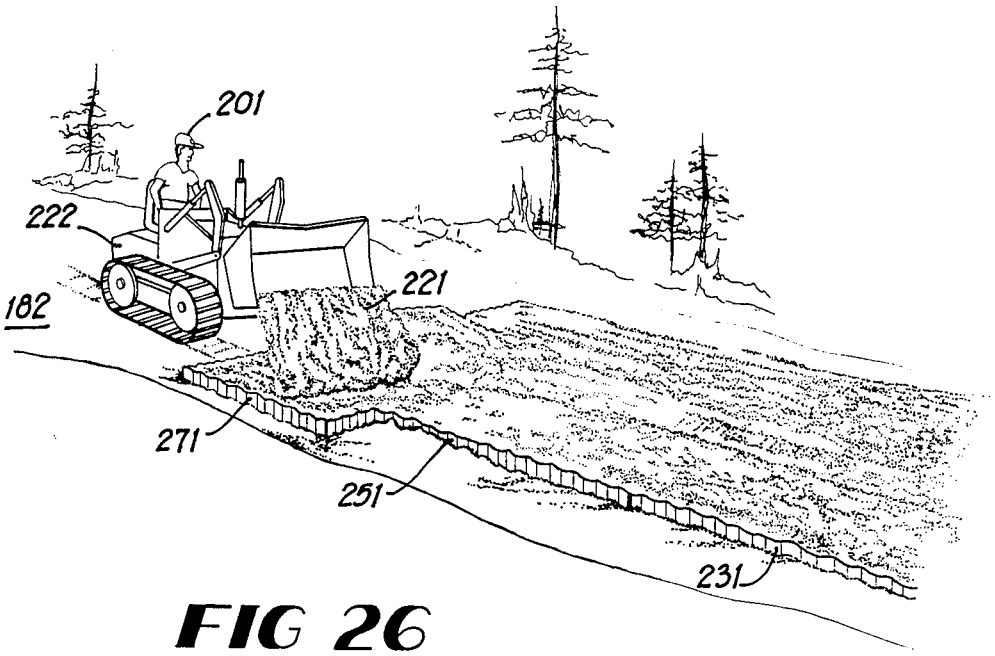

FIG. 26 illustrates three grid sections of cells on land.

Figure 27:
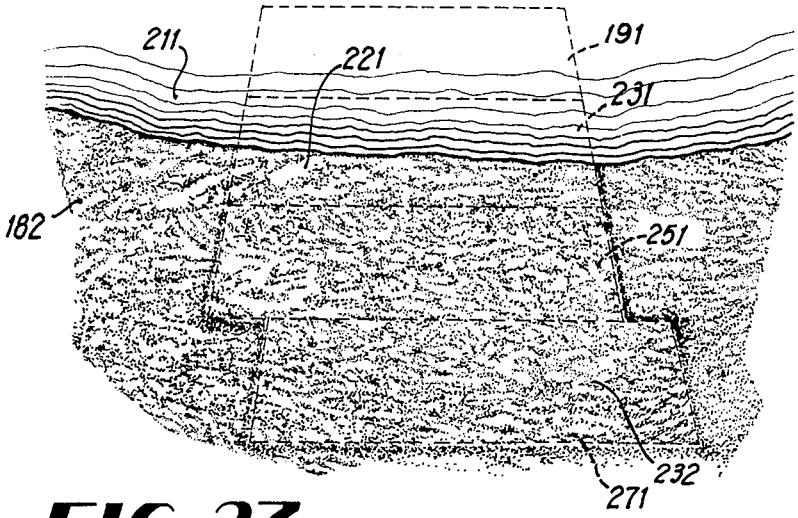

FIG. 27 illustrates four grid sections of cells completely installed at a boat ramp.

Figure 28:
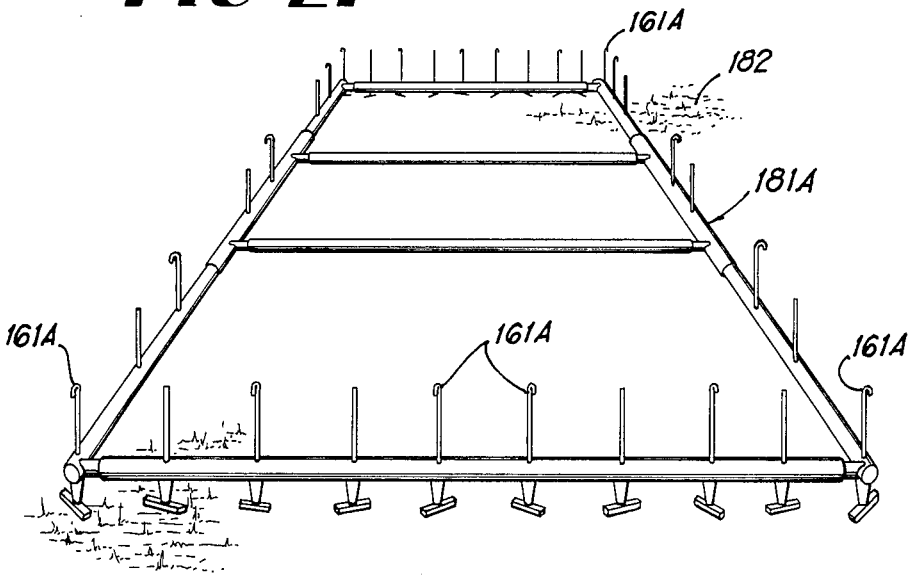

FIG. 28 illustrates an installation frame showing a second alternate embodiment.

Figure 29:
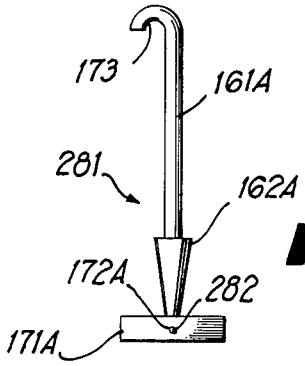

FIG. 29 illustrates a grid section holding member showing an alternate embodiment.

Figure 30:
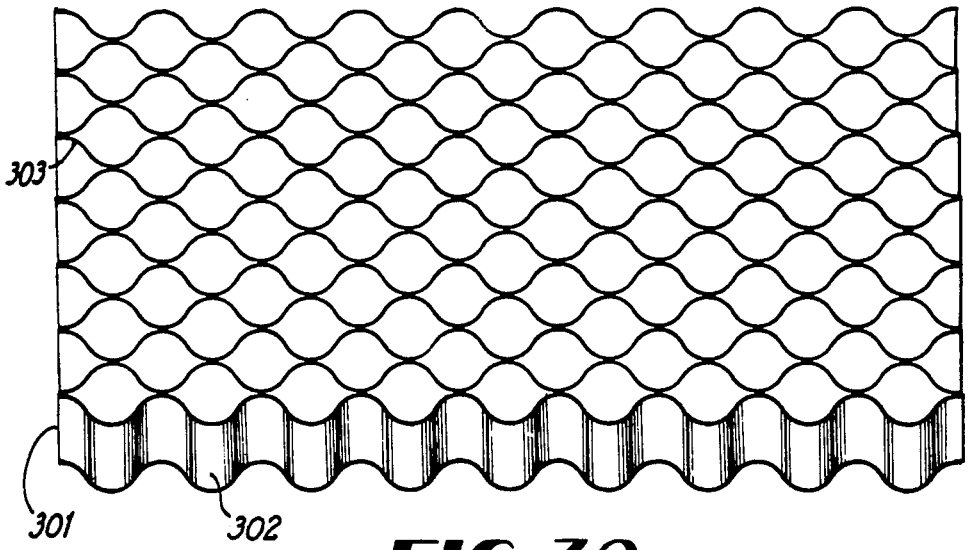

FIG. 30 illustrates a partial view of a grid section of Geoweb.

Figure 31:
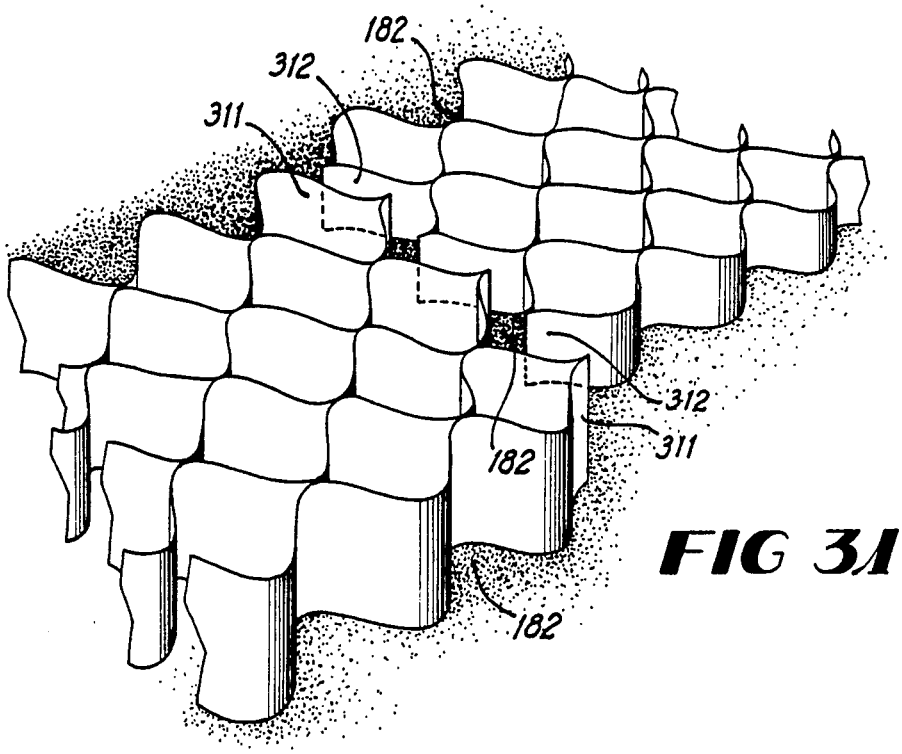

FIG. 31 illustrates a partial view of two interlocking grid sections of Geoweb.

DESCRIPTION OF THE PREFERRED EMBODIMENTS

Figure 1:
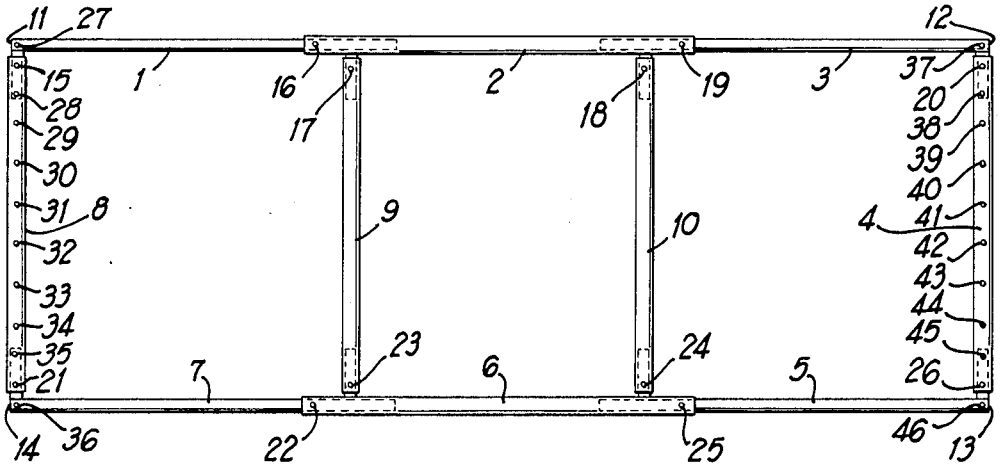
FIG. 1 illustrates an installation frame.

FIG. 1 illustrates a frame for installing a grid section of cells of a grid confinement system for soil which is generally planar. The frame has a plurality of support members forming sides and providing support whereby each support member is connected to two or more support members. The preferred frame is a generally planar rectangle having two short sides, 4 and 8, respectively, and two long sides, 1–3 and 5–7, respectively. The frame has internal support members 9 and 10. Openings 27–36 and 37–46 are for grid section holding members disposed along the two short sides of the rectangle.

Openings 15–20 and 21–26 are for connecting means of the support members including the two internal support members. Such connecting means include but are not limited to steel hitch pins and the like. In the preferred embodiment the support members are connected utilizing external connecting means; however, such support members including but not limited to internal support members may also be connected utilizing integral connecting means. Any two or more of such support members including but not limited to internal support members may be connected by being formed, set or cast utilizing a single mold for such support members. Ventilation means are provided to facilitate underwater installation of the generally planar frame. Water, air or the like may freely pass through the ventilation means. Ventilation means of the support members including internal support members includes openings 11–14 on the corners of the frame; however, such ventilation means is not limited to openings 11–14 and may include other suitable ventilation means such as a plurality of openings in any support member including any internal support member. The support members can be formed from a material such as an alloy, a metal, or a plastic resin. Thermoformed or thermoset plastic resins may be utilized. In the preferred embodiment, the support members are formed from an open ended aluminum pipe. The grid section holding members of the preferred embodiment are disposed at each cell along the two short sides of the rectangle. In the preferred embodiment the dimensions of the rectangle include a length of approximately 20 feet and a width of approximately 8 feet having two internal support members. A preferred range size of the rectangle is a rectangle formed from two long sides each having a length of about 3 feet to about 20 feet and two short sides each having a length from about 2 feet to about 8 feet. The frame of the present invention may be used for installation on land, underwater or any combination thereof.

Figure 2:
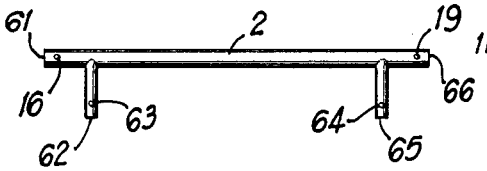

FIG. 2 illustrates a support member 2 having openings 61, 62, 65 and 66 for ventilation means of the support member. Openings 16, 19, 63 and 64 are provided for connecting means of the support members 1, 2, 3, 9 and 10.

Figure 3:
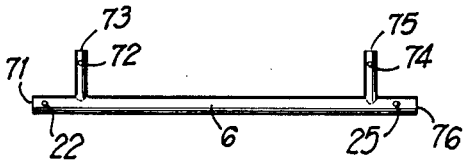

Similarly, FIG. 3 illustrates a support member 6 having openings 71, 73, 75 and 76 for ventilating means of the support member. Openings 22, 25, 72 and 74 are provided for connecting means of the support members 5, 6, 7, 9 and 10.

Figure 4:
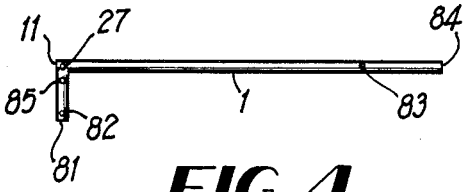

FIG. 4 illustrates a support member 1 having openings 11, 81 and 84 for ventilating means of the support member. Openings 83 and 85 are provided for a connecting means of support members 1, 2 and 8. Openings 27 and 82 are provided for grid section holding members.

Figure 5:
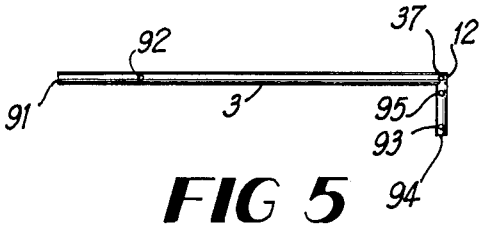

FIG. 5 illustrates a support member 3 having openings 12, 91 and 94 for ventilation means of the support member. Openings 92 and 95 are for a connecting means of support members 2, 3 and 4. Openings 37 and 92 are provided for grid section holding members.

Figure 6:
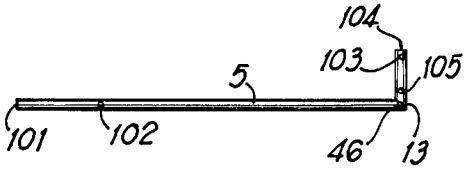

FIG. 6 illustrates a support member 5 having openings 13, 101 and 104 for a ventilating means of the support member. Openings 102 and 105 are for a connecting means of support members 4, 5 and 6. Openings 46 and 102 are provided for grid section holding members.

Figure 7:
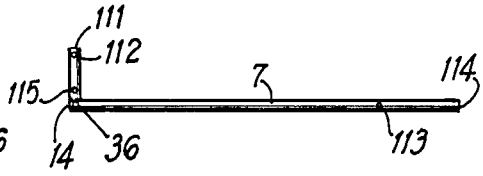

FIG. 7 illustrates a support member 7 having openings 14, 111 and 114 for ventilation means of the support member. Openings 113 and 115 are for connecting means of support members 6, 7 and 8. Openings 36 and 112 are provided for grid section holding members.

Figure 8:
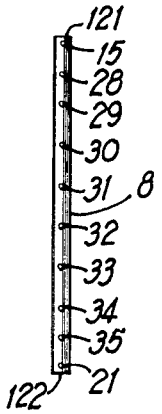

FIG. 8 illustrates a support member 8 which is a short side of the rectangle. Openings 121 and 122 are ventilation means of the support member. Openings 28–35 are for grid section holding members. Openings 15 and 21 are provided for connecting means of support members 1, 7 and 8.

Figure 9:
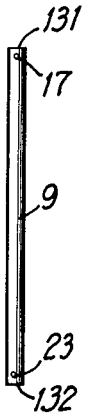

FIG. 9 illustrates an internal support member 9 having openings 131 and 132 for ventilation means of the internal support member. Openings 17 and 23 are for connecting means of support members 2, 6 and 9.

Figure 10:
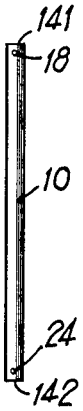

FIG. 10 illustrates an internal support member 10 having openings 141 and 142 for ventilation means of the internal support member. Openings 18 and 24 are provided for connecting means of support members 2, 6 and 10.

Figure 11:
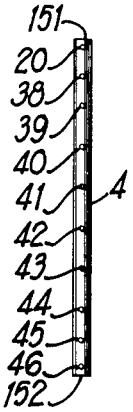

FIG. 11 illustrates a support member 4 which is a short side of the rectangle. Openings 38–45 are for grid section holding members. Openings 151 and 152 are ventilation means of the support member. Openings 20 and 26 are provided for connecting means of support members 3, 4 and 5.

Figure 12:
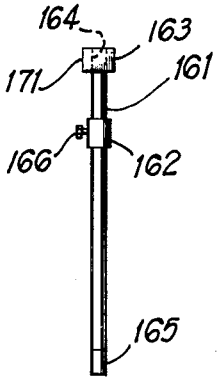

FIG. 12 illustrates a grid section holding member 161 having a control attaching block 163 for control means 171. 164 is an opening for a control attaching means of the control means 171. The control attaching block 163 of the preferred embodiment includes but is not limited to a rectangular aluminum bar or the like. The control attaching block 163 of the preferred embodiment is externally mounted; however, such control attaching block 163 can also be integrally mounted. The control attaching means includes but is not limited to a steel roll pin or the like. The control means 171 in the preferred embodiment is externally mounted; however, such control means 171 can also be integrally mounted. A holding attaching means 165 for a grid section holding means 173 is mounted integrally in the preferred embodiment; however, such holding attaching means 165 can also be externally mounted. The grid section holding member 161 is vertically slidable in the preferred embodiment. A positive stop 162 is integrally or externally mounted on the grid section holding member 161. The positive stop includes, but is not limited to, a collar or a sleeve. In the preferred embodiment the positive stop is an externally mounted sleeve. The grid section holding member 161 is formed from material including, but not limited to an alloy, a metal or a plastic resin. Both thermoformed and thermoset plastic resins are suitable In the preferred embodiment the grid section holding member 161 is steel. 166 is an opening for a stop attaching means for the positive stop 162 shown with the stop attaching means inserted therein. The stop attaching means is a steel roll pin in the preferred embodiment.

Figure 13:
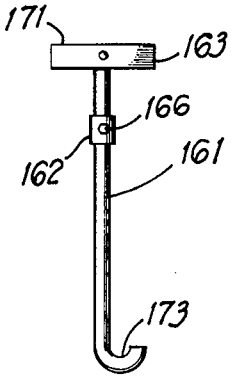

FIG. 13 illustrates a grid section holding member 161 similar to FIG. 12 except that FIG. 13 illustrates a control means 171 as a handle and a grid section holding means 173 as a hook. In the preferred embodiment the grid section holding means 173 is on an opposite side of a generally planar frame from the control means 171 which also supports the generally planar frame when the grid section of cells is being secured to the generally planar frame. The handle in FIG. 13 is shown as a "T" handle and the hook is shown as a "J" hook. The grid section holding means 173, positive stop 162, control means 171 and control attaching block 164 are all externally mounted in FIG. 13; however, the holding attaching means 165 illustrated in FIG. 12 is integrally mounted. The grid section holding member 161 rotates about an axis perpendicular to the plane of the grid section of cells 181 when the grid section of cells 181 is secured to the generally planar frame. The grid section holding means also includes a planar extension of the grid section holding member 161 which is not a "J" hook. A grid section holding means which is a "J" hook provides planar support to hold the grid section of cells stretched open and vertical support to hold the grid section of cells on the generally planar frame. A grid section holding means which is a planar extension of the grid section holding member 161 is not a "J" hook or the like and provides planar support to hold the grid section of cells stretched open and partial vertical support to hold the grid section of cells on the generally planar frame.

FIG. 14 illustrates an installation frame for a grid soil confinement system which is generally planar showing an alternate embodiment similar to FIG. 1 except that openings 28, 30, 35, 38, 40, 43 and 45 are not present in FIG. 14. In FIG. 14 openings for grid section holding members are disposed at every other cell along two short sides of a rectangle, and an additional grid section holding member is disposed along each of the two short sides of the rectangle whereby the grid section holding members on each of the two short sides of the rectangle are disposed at two adjacent cells defining a center point on each of the two short sides of the rectangle. In addition to the embodiment shown in FIG. 14, the grid section holding members may be disposed along the two short sides of the rectangle at every other cell. While the preferred embodiment is a rectangle, the frame includes a square or any other shape having a plurality of support members forming sides and providing support for the generally planar frame. A generally planar frame includes frame bowing, bending or curvature whether in a vertical or horizontal plane. The present invention is not limited to rigid materials or a rigid structure. A generally planar frame which is a square has grid section holding members disposed along two sides thereof. The preferred embodiment of the generally planar frame which is a square is for the grid section holding members to be disposed along two opposite sides of the square.

FIG. 15 illustrates a completely assembled installation frame 181 which is generally planar and which is positioned on the ground or soil 182. The installation frame 181 is the preferred embodiment shown in FIG. 1 having components thereof illustrated in FIGS. 2–13. A plurality of grid section holding members 161 are disposed along two sides of the generally planar frame 181 to engage the grid section of cells and secure same to the generally planar frame 181. Each grid section holding member 161 has a grid section holding means for engaging the grid section of cells and a control means 171 for activating the grid section holding means. A plurality of the grid section holding members have grid section holding means which are "J" hooks. The present figure illustrates the preferred arrangement of grid section holding means with "J" hooks and grid section holding means without "J" hooks. The control means 171 supports the generally planar frame 181 generally horizontally above soil 182. The control means 171 for each grid section holding means is independently operable of the control means 171 for any other grid section holding means wherein each grid section holding means can be controlled independently of any other grid section holding means. The term operable includes actuated, activated and the like and is not limited to direct manual control but may also include automated control known to those skilled in the art. Direct manual control, however, is used in the preferred embodiment to facilitate the use of unskilled and/or untrained laborers.

FIG. 16 illustrates the installation frame 181 of FIG. 15 with a grid section of cells 191 secured to same and positioned at each cell along such two sides having a plurality of support members forming sides and providing support for the generally planar frame 181 utilizing a plurality of grid section holding members 161 disposed along two sides of the generally planar frame 181 and positioned at each cell along such two sides to engage the grid section of cells 191 wherein each grid section holding member 161 has a grid section holding means for engaging the grid section of cells 191 and a control means 171 for activating the grid section holding means which engages or disengages the grid section holding means from the grid section of cells 191. The grid section of cells 191 shown in this figure has a geometric pattern and is sinuous or undulent. The control means 171 support the generally planar frame 181 generally horizontally above the soil 182.

FIG. 17 illustrates transporting an installation frame 181 having a grid section of cells 191 secured thereto to an installation site which is the confinement location. Only two laborers 201 and 202 standing on the soil 182 are required to install a grid section of cells 191.

FIG. 18 illustrates rotating the installation frame 181 to position the grid section of cells 191 below the installation frame 181 and on the soil 182 at the confinement location. In the preferred embodiment the grid section of cells 191 is initially secured on top of the installation frame 181 utilizing the grid section holding means to engage the grid section of cells 191. The installation frame 181 is then rotated to position the grid section of cells 191 below the installation frame 181 before positioning the grid section of cells 191 secured to the installation frame 181 on the soil 182 at the confinement location. In the preferred embodiment the grid section of cells 191 secured to the installation frame 181 is transported to the confinement location before positioning the grid section of cells 191 on the soil 182 at the confinement location. The soil includes but is not limited to sand, clay, silt, rock, organic matter and combinations thereof. FIG. 18 illustrates the rotated frame 181 having a grid section of cells 191 secured thereto. Two laborers 201 and 202 can easily rotate the installation frame 181. In the preferred embodiment, rotation is necessary in order to position the grid section of cells 191 at confinement location on the soil 182.

FIG. 19 illustrates positioning the installation frame 181 having a grid section of cells 191 in an underwater confinement location which is an installation site. The installation frame 181 and grid section of cells 191 are shown being positioned at the confinement location on the soil below water 211 in an area used as a boat ramp from the soil 182 to the water 211.

FIG. 20 illustrates an anchoring means comprising in-fill material 221 being placed on the grid section of cells 191 to anchor same into position at an underwater confinement location before disengaging the grid section holding means 171 from the grid section cells 191. In the preferred embodiment, a mechanical means 222 on the soil 182 is used to load the in-fill material 221 requiring one of the two laborers 201 and 202 to operate same. An additional laborer may be used to operate the mechanical means 222 which is a front end loader or other earth or soil 182 moving equipment. After the grid section of cells 191 is anchored into position at the underwater confinement location, the grid section of cells 191 is filled with in-fill material 221. The in-fill material 221 includes but is not limited to sand, clay, silt, rock, organic matter and combinations thereof. The grid section holding means 171 is disengaged from the grid section of cells 191 to release the grid section of cells 191 from the generally planar frame 181. The anchoring means comprising the in-fill material 221 prevents movement of the grid section of cells. Additional in-fill material referred to as a surcharge 232 as shown in FIG. 21 for a grid section of cells 231 is placed on top of the grid section of cells 191 to protect same during installation underwater or partially underwater or particularly during compaction whether on land, underwater or partially underwater. The surcharge 232 may be compacted on top of and around the grid section of cells 191.

FIG. 21 illustrates a second grid section of cells 231 attached to the installation frame 181 and being installed adjacent to the first grid section of cells 191 partially underwater on the soil and above water level on the soil 182. If Geoweb is used, each grid section of cells will interlock with an adjacent cell; however, an interlocking means may be required depending upon the actual type of grid section of cells being utilized. Two laborers 201 and 202 are shown positioning grid section of cells 231. A surcharge 232 of in-fill material 221 is shown on top of the first grid section 181.

FIG. 22 illustrates in-fill material 221 being placed on the second grid section of cells to anchor same in place on the soil 182 at the confinement location. In the preferred embodiment, the anchoring means for preventing movement of the grid section of cells at the confinement location is filling a plurality of cells of the grid section of cells 231 with an in-fill material 221. Alternate embodiments for the anchoring means include, but are not limited to, filling a perimeter of the grid section of cells 231 with an in-fill material 221, anchoring the grid section of cells 231 using temporary stakes or filling the entire grid section of cells 231 with in-fill material 221. In the preferred embodiment, a surcharge 232 of the in-fill material 221 is placed on the grid section of cells 231 to protect the grid section of cells 231 during compaction of the in-fill material 221 on top of and around the grid section of cells 231. In an alternate embodiment, a geotextile is positioned on the soil 182 at the confinement location before positioning the grid section of cells 191 and/or 231 secured to the installation frame on the soil at the confinement location. Geotextiles include but are not limited to woven cloth and nonwoven cloth.

FIG. 23 illustrates a third grid section of cells 251 on the soil 182 and a surcharge 232 on top of the second grid section of cells 231 on the soil 182.

FIG. 24 illustrates three grid sections of cells 251, 231, and 191 installed on the soil 182 on land and underwater.

FIG. 25 illustrates a fourth grid section of cells 271 installed on the soil 182 on land adjacent to the third grid section of cells 231. In FIG. 25 the fourth grid section of cells 271 is installed slightly offset from the third grid section of cells 251 which is a means of providing for curves in the soil confinement area and specifically in the boat ramp illustrated in FIG. 25. A surcharge 232 is shown on top of the fourth grid section of cells 271.

FIG. 26 illustrates three grid sections of cells 271, 251, and 231 being installed on land on the soil 182 where in-fill material 221 being placed on the grid sections by mechanical means 222.

FIG. 27 illustrates four grid sections of cells 191, 231, 251 and 271 completely installed on land on the soil 182 and underwater 211 at the boat ramp shown in FIG. 19. All four grid sections 191, 231, 251 and 271 are completely covered with a surcharge 232 of in-fill material 221.

The grid section of cells illustrated in FIGS. 17–27 is a schematic representation of a grid section of cells having a geometric pattern which is sinuous or undulent.

FIG. 28 illustrates an installation frame 181A showing a second alternate embodiment. FIG. 28 is the same as FIG. 15 except that grid section holding members 161A are disposed along all four sides and positioned at each cell along two short sides and at a plurality of cells along the two long sides wherein the grid section holding means of the grid section holding members along the two long sides is a planar extension of the grid section holding member and is or is not a "J" hook or the like and function as described for FIG. 15 and except that each assembled grid section holding member 281 has a positive stop 162A mounted as shown in FIG. 29. The grid section holding members 161A are vertically slidable. The installation frame 181A may have configurations and/or sizes other than the rectangle shown including but not limited to other rectangles and any squares. Such configurations and/or sizes other than the rectangle shown are examples of other alternate embodiments. Additionally, other alternate embodiments include but are not limited to disposing holding members 161A along all four sides at each cell along the four sides, at every other cell or at predetermined or preselected cells on the four sides other than as illustrated in the present figure. Another alternate embodiment is to use grid section holding members 161 assembled as shown in FIG. 13 with or without "J" hooks or the like or any variation assembly thereof known to those skilled in the art.

FIG. 29 illustrates an assembled grid section holding member 281 which is preferred over the embodiment of FIG. 13. FIG. 29 is like FIG. 13 except that a positive stop 162A and a control means 171A are both attached to the grid section holding member 161A by an attaching means 282 at the same location 172A on the holding member 161A. Specifically, the attaching means 282 which is a steel roll pin in the preferred embodiment is inserted into an opening 172A through the positive stop 162A and the control means 171A. The attaching means 282 is not limited to a roll pin and includes a press fit pin or the like. Also, the attaching means 282 may be formed from an alloy, a metal, a plastic resin or the like. If the attaching means 282 is formed from a metal, steel, aluminum or the like are suitable metals. The grid section holding means 173 is a "J" hook which is the same as illustrated in FIG. 13. The grid section holding means also includes a planar extension of the grid section holding member 161A which is not a "J" hook. A grid section holding means which is a "J" hook provides planar support to hold the grid section of cells stretched open and vertical support to hold the grid section of cells on the generally planar frame. A grid section holding means which is a planar extension of the grid section holding member 161 and not a "J" hook or the like provides planar support to hold the grid section of cells stretched open and partial vertical support to hold the grid section of cells on the generally planar frame.

FIG. 30 illustrates a partial view of a grid section of Geoweb 301. The partial view of a grid section of Geoweb has a side 302 and sinuous or undulent cells 303 as shown in a top view.

FIG. 31 illustrates a partial view of two interlocking grid sections of Geoweb. A first grid section of Geoweb 311 is installed adjacent to and interlocking with a second grid section of Geoweb 312 on the soil 182.

EXAMPLE 1

The installation frame illustrated in FIGS. 1 and 15 was used to install a grid section of cells in accordance with the method illustrated in FIGS. 16–27. Two laborers were required to install the grid section of cells. The time required to secure the grid section of cells to the installation frame at a location near the installation site and to position the grid section of cells on the soil at the installation site which was the confinement location was from about four minutes to about eight minutes for installation on land, partially on land and partially underwater or underwater. The grid section of cells usually did not prematurely release from the installation frame. More time was required for underwater or partially underwater installations than for installations on land to anchor the grid section of cells in place at the confinement location, to fill the grid section of cells with an in-fill material and to place a surcharge of an in-fill material on top of the grid section of cells.

EXAMPLE 2

The installation frame illustrated in FIG. 14 was used to install a grid section of cells in accordance with the method illustrated in FIGS. 16–27. Two laborers were required to install the grid section of cells. The time required to secure the grid section cells to the installation frame at a location near the installation site and to position the grid section of cells on the soil at the installation site which the confinement location was from about four mintues to about eight minutes for installations on land, partially on land and partially underwater or underwater except that the installation frame illustrated in FIG. 14 did not secure the grid section of cells to such frame as well as the installation frame illustrated in FIGS. 1 and 15 and utilized in Example 1, above. Additional time was required to resecure the grid section of cells to the installation frame of FIG. 14 when the grid section of cells prematurely released from the installation frame of FIG. 14 which frequently occurred with the frame of FIG. 14. More time was required for underwater or partially underwater installations than for installations on land as described in Example 1, above.

EXAMPLE 3

The installation frame illustrated in FIG. 28 is used to install a grid section of cells in accordance with the method illustrated in FIGS. 16–27. Two laborers are required to install the grid section of cells. The time required to secure a grid section of cells to the installation frame at a location near the installation site and to position the grid section of cells on the soil at the installation site which is the confinement location is from about four minutes to about eight minutes for installations on land, partially on land and partially underwater or underwater. The grid section of cells does not prematurely release from the installation frame of FIG. 28. The installation frame of FIG. 28 requires slightly more time on average to install than the installation frame of FIGS. 1 and 15 as utilized in Example 1, above. More time is required for underwater or partially underwater installations than for installations on land as described in Example 1, above.

EXAMPLE 4

The installation frame of FIGS. 1 and 15 except with the assembled grid section holding member of FIG. 29 rather than the embodiment of FIG. 13 was used to install a grid section of cells as described in Example 1, above. Two laborers were required to install the grid section of cells. The time required to secure the grid section of cells to the installation frame of a location near the installation site and to position the grid section of cells on the soil at the installation site which was the confinement location was from about four minutes to about eight minutes on land, partially on land and partially underwater or underwater. The grid section of cells usually did not prematurely release from the installation frame. More time was required for underwater or partially underwater installations than for installations on land as described in Example 1, above. Example 4 is an example of the preferred embodiment of the present invention.

EXAMPLE 5

A wood installation frame having fixed holding members disposed along two short sides 4 and 8 of approximately 8 feet each and having two long sides of approximately 20 feet each perpendicular and connected to the short sides between fixed holding members at openings 27 and 29 and between fixed holding members at openings 37 and 39 for the first long side and between fixed holding members at openings 34 and 36 and between fixed holding members at openings 44 and 46 for the second long side wherein the two short sides and fixed holding members are positioned as shown in FIG. 14 for the two short sides and the openings for the grid section holding members. The fixed holding members were not vertically slidable or otherwise movable in any direction. The two long sides were braced for additional support. Two laborers were required to install the grid section of cells. The grid section of cells was stretched over the fixed holding members and tied to the wood installation frame. The wood installation frame with the grid section of cells tied on top of the wood installation frame was transported to the confinement location. The wood installation frame was rotated over with the grid section of cells tied to the wood installation frame. The grid section of cells was positioned on the soil at the confinement location. The perimeter of the grid section of cells was anchored with in-fill material. The grid section of cells was untied from the wood installation frame, and the wood installation frame was removed from the confinement location. The grid section of cells was filled with additional in-fill material and a surcharge of in-fill material was added on top of the grid section of cells. The surcharge protected the grid section of cells at the confinement location particularly during compaction. Installation underwater was extremely difficult due in part to the buoyancy of the wood installation frame. For partially underwater or underwater installations, the wood installation frame of the present example with a grid section of cells secured thereto was not as easy to position or reposition as the frames of Examples 1 and 2, above, with the grid sections of cells secured thereto. The time required to secure the grid section of cells to the wood installation frame including tying the grid section of cells to the wood installation frame and to position the grid section of cells on the soil at the installation site which was the confinement location was substantially greater than the four to eight minute range described in Examples 1 and 4, above. Substantially more time was required for underwater or partially underwater installations than for installations on land to anchor the grid section of cells in place at the confinement location, to fill the grid section of cells with an in-fill material and to place a surcharge an in-fill material on top of the grid section of cells wherein anchoring the grid section of cells was the rate determining step due to the buoyancy of the wood installation frame.

EXAMPLE 6

The grid section of cells was installed without using an installation frame. Eight laborers were required to install the grid section of cells. The present example required a string line to provide installation uniformity and did not provide an easy reference to site along and align the grid section of cells center line with the road center line. Also, the present example did not provide easy cell interlock between grid sections of cells. The time requried to position the grid section of cells on the soil at the installation site which was the confinement location was substantially greater than the four to eight minutes range of Examples 1 and 4, above. More time was required for underwater or partially underwater installations than for installations on land to anchor the grid section of cells in place at the confinement location, to fill the grid section of cells with an in-fill material and to place a surcharge of an in-fill material on top of the grid section of cells.

The present invention being thus described, it will be obvious that the same will be varied in many ways. Such variations are not intended as a departure from the spirit or scope of the invention and all such modifications as would be obvious to one skilled in the art are intended to be included within the scope of the following claims.

I claim:

1. A frame for installing a grid section of cells of a grid confinement system for soil comprising:

a generally planar frame having a plurality of support members connected to one another forming sides of the frame and providing a coherent frame structure; and a plurality of grid section holding members disposed along two sides of the generally planar frame to engage the grid section of cells wherein:

each grid section holding member has a grid section holding means for engaging the grid section of cells and a control means for activating the grid section holding means;

the control means for each grid section holding means is independently operable of the control means for any other grid section holding means; and each grid section holding means can be controlled independently of any other grid section holding means.

2. The frame of claim 1 wherein the soil is selected from the groups consisting of sand, clay, silt, rock, organic matter and combinations thereof.

3. The frame of claim 2 wherein the cells are formed from a material selected from the group consisting of paper, an alloy, metal and a plastic resin.

4. The frame of claim 3 wherein the cells are formed from the plastic resin selected from the group consisting of a thermoformed plastic resin and a thermoset plastic resin.

5. The frame of claim 3 wherein the grid section is a honeycomb of cells.

6. The frame of claim 3 wherein the cells are undulent.

7. The frame of claim 3 wherein the cells are sinuous.

8. The frame of claim 3 wherein the grid section is a geometric pattern of cells.

9. The frame of claim 3 wherein the generally planar frame is a rectangle having two short sides and two long sides;

the grid section holding members are disposed along the two short sides of the rectangle;

the grid section holding means is integrally mounted on the grid section holding member;

the control means is integrally mounted on the grid section holding member;

a positive stop is integrally mounted on the grid section holding member; and the support members are hollow having a ventilation means.

10. The frame of claim 9 wherein the grid section holding members are disposed at each cell along the two short sides of the rectangle.

11. The frame of claim 10 wherein the grid section holding members are disposed at a plurality of cells along the two long sides of the rectangle.

12. The frame of claim 10 wherein the control means is externally mounted on the grid section holding member.

13. The frame of claim 10 wherein the positive stop is externally mounted on the grid section holding member.

14. The frame of claim 9 wherein the positive stop is a collar.

15. The frame of claim 9 wherein the positive stop is a sleeve.

16. The frame of claim 9 wherein the support members are formed from open-ended pipe formed from a material selected from the group consisting of an alloy, a metal and a plastic resin.

17. The frame of claim 16 wherein the open-ended pipe is formed from the plastic resin selected from the group consisting of a thermoformed plastic resin and a thermoset plastic resin.

18. The frame of claim 16 wherein the metal is aluminum.

19. The frame of claim 9 wherein the grid section holding members are disposed at every other cell along all four sides of the rectangle.

20. The frame of claim 9 wherein two grid section holding members are disposed along each of the two short sides of the rectangle whereby the grid section holding members on each of the two short sides of the rectangle are disposed at two adjacent cells defining a center point on the two short sides of the rectangle; and additional grid section holding members are disposed at every other cell from the two grid section holding members disposed at the two adjacent cells along the two short sides of the rectangle.

21. The frame of claim 20 having grid section holding members similarly disposed along the two long sides of the rectangle.

22. The frame of claim 9 wherein each grid section holding member is vertically slidable.

23. The frame of claim 9 wherein the grid section holding means is externally mounted on the grid section holding member.

24. The frame of claim 9 wherein the control means is externally mounted on the grid section holding member.

25. The frame of claim 9 wherein the positive stop is externally mounted on the grid section holding member.

26. The frame of claim 25 wherein the positive stop is a collar.

27. The frame of claim 25 wherein the positive stop is a sleeve.

28. The frame of claim 21 wherein:

the grid section holding means is a hook; and the control means is a handle.

29. The frame of claim 9 wherein the grid section of cells is installed on land.

30. The frame of claim 9 wherein the grid section of cells is installed underwater.

31. The frame of claim 9 wherein the rectangle is formed from two long sides each having a length of from about 3 feet to about 20 feet and two short sides each having a length of from about 2 feet to about 8 feet; and the grid section holding member is formed from a material selected from the group consisting of an alloy, a metal and a plastic resin.

32. The frame of claim 31 wherein the rectangle has a plurality of internal support members; and the grid section holding member is formed from the plastic resin selected from the group consisting of a thermoformed plastic resin and a thermoset plastic resin.

33. The frame of claim 32 wherein the rectangle has a length of approximately 20 feet, a width of approximately 8 feet, and two internal support members; and the grid section holding member is formed from steel.

34. The frame of claim 9 wherein the generally planar frame is a square having grid section holding members disposed along two sides.

35. The frame of claim 34 wherein the grid section holding members are disposed along two opposite sides.

36. A method for installing a grid section of cells of grid confinement system for soil comprising:

securing the grid section of cells to a generally planar frame, having a plurality of support members connected to one another forming sides of the frame and providing a coherent frame structure, utilizing a plurality of grid section holding members disposed along two sides of the generally planar frame to engage the grid section of cells wherein:

each grid section holding member has a grid section holding means for engaging the grid section of cells and a control means for activating the grid section holding means;

the control means for each grid section holding means is independently operable of the control means for any other grid section holding means; and each grid section holding means can be controlled independently of any other grid section holding means;

positioning the grid section of cells secured to the generally planar frame on the soil at a confinement location;

anchoring the grid section of cells in place at the confinement location utilizing an anchoring means to prevent movement of the grid section of cells; and releasing the generally planar frame from the grid section of cells utilizing the control means to disengage the grid section holding means for the grid section of cells.

37. The method of claim 36 wherein the anchoring means comprises temporary stakes.

38. The method of claim 36 wherein the anchoring means comprises filling a perimeter of the grid section of cells with an in-fill material.

39. The method of claim 36 wherein the anchoring means comprises filling a plurality of cells of the grid section of cells with an in-fill material.

40. The method of claim 36 wherein the anchoring means comprises filling the grid section of cells with an in-fill material.

41. The method of claim 38 wherein the in-fill material is selected from the group consisting of sand, clay, silt, rock, organic matter and combinations thereof.

42. The method of claim 36 having a first additional step of filling the grid section of cells with an in-fill material selected from the group consisting of sand, clay, silt, rock, organic matter and combinations thereof.

43. The method of claim 42 having a second additional step of adding a surcharge of the in-fill material on top of the grid section of cells.

44. The method of claim 36 wherein:

a geotextile is positioned on the soil at the confinement location before positioning the grid section of cells secured to the generally planar frame on the soil at the confinement location.

45. The method of claim 44 wherein the geotextile is selected from the group consisting of a woven cloth and a nonwoven cloth.

46. The method of claim 36 wherein:

the grid section of cells secured to the generally planar frame is rotated to position the grid section of cells below the generally planar frame before positioning the grid section of cells secured to the generally planar frame on the soil at the confinement location; and the grid section of cells secured to the generally planar frame is transported to the confinement location before positioning the grid section of cells on the soil at the confinement location.

47. The method of claim 36 wherein the soil is selected from the group consisting of sand, clay, silt, rock, organic matter and combinations thereof.

48. The method of claim 43 wherein the surcharge is compacted on top of and around the grid section of cells.

* * * * *

UNITED STATES PATENT AND TRADEMARK OFFICE

CERTIFICATE OF CORRECTION

PATENT NO. : 4,717,283

DATED : January 5, 1988

INVENTOR(S) : Gary Bach

It is certified that error appears in the above-identified patent and that said Letters Patent is hereby corrected as shown below:

Title page:

IN THE SECTION ENTITLED "OTHER PUBLICATIONS"

In the article entitled "Paving Grid Repertoire Expands" in the Engineer News Record, p. 32, please change the date from "(Jul. 1984)" to --(Jul. 26, 1984)--.

IN THE BACKGROUND AND SUMMARY OF THE INVENTION

In column 2, line 20, please delete "Webster-Steve" and substitute therefor --Webster, Steve--;

In column 2, line 26, please delete "Webster Steve" and substitute therefor --Webster, Steve--.

IN THE BRIEF DESCRIPTION OF THE DRAWINGS

In column 4, line 25, please delete "frame;" and substitute therefor --frame.--;

In column 4, line 39, after the words "on the" please insert --second--;

In column 6, line 50, please insert a period (.) after the word "suitable".

UNITED STATES PATENT AND TRADEMARK OFFICE

CERTIFICATE OF CORRECTION

PATENT NO. : 4,717,283

DATED : January 5, 1988

INVENTOR(S) : Gary Bach

It is certified that error appears in the above-identified patent and that said Letters Patent is hereby corrected as shown below:

IN THE CLAIMS

In Claim 36 (column 16, line 17), please delete "for the grid" and substitute therefor --from the grid--.

Signed and Sealed this

Seventh Day of February, 1989

*Attest:*

*Attesting Officer*

DONALD J. QUIGG

*Commissioner of Patents and Trademarks*